US006273183B1

(12) United States Patent
So et al.

(10) Patent No.: US 6,273,183 B1
(45) Date of Patent: Aug. 14, 2001

(54) HEAT EXCHANGER TURBULIZERS WITH INTERRUPTED CONVOLUTIONS

(75) Inventors: Allan K. So; Peter Zurawel; Dan Constantin Stefanoiu, all of Mississauga (CA)

(73) Assignee: Long Manufacturing Ltd., Oakville (CA)

( * ) Notice: Subject to any disclaimer, the term of this patent is extended or adjusted under 35 U.S.C. 154(b) by 0 days.

(21) Appl. No.: 09/591,344

(22) Filed: Jun. 9, 2000

Related U.S. Application Data

(63) Continuation-in-part of application No. 09/064,218, filed on Apr. 22, 1998.

(30) Foreign Application Priority Data

Aug. 29, 1997 (CA) ..... 2214255

(51) Int. Cl.[7] ..... F28F 13/12
(52) U.S. Cl. ..... 165/109.1; 165/152
(58) Field of Search ..... 165/152, 153, 165/166, 167, 916, 109.1

(56) References Cited

U.S. PATENT DOCUMENTS

Re. 35,890 * 9/1998 So ..... 165/109.1
2,360,123 * 10/1944 Gerstung et al. ..... 165/109.1
2,990,163 * 1/1961 Farrell ..... 165/152
4,712,612 * 12/1987 Okamoto et al. ..... 165/153
5,036,911 * 8/1991 So et al. ..... 165/153
5,209,289 * 5/1993 Haushalter ..... 165/109.1
5,560,425 * 10/1996 Sugawara et al. ..... 165/153

* cited by examiner

*Primary Examiner*—Ira S. Lazarus
*Assistant Examiner*—Terrell McKinnon
(74) *Attorney, Agent, or Firm*—Ridout & Maybee

(57) ABSTRACT

A heat exchanger is disclosed of the type having stacked plate pairs or tubes defining flow passages, with turbulizer located inside such flow passages. The turbulizers are of the expanded metal type having rows of convolutions. The convolutions are interrupted periodically to form non-convoluted pressure recovery zones located between or downstream of the convolutions. Also, the rows of convolutions can be grouped and spaced apart to provide longitudinal neutral zones between groups of adjacent rows of convolutions. The pressure recovery zones and longitudinal neutral channels reduce pressure drop in the heat exchanger without appreciably reducing heat transfer.

18 Claims, 9 Drawing Sheets

HEAT EXCHANGER TURBULIZERS WITH INTERRUPTED CONVOLUTIONS

This is a continuation-in-part of application Ser. No. 09/064,218 filed Apr. 22, 1998.

FIELD OF THE INVENTION

The present invention relates to heat exchangers, and in particular, to turbulizers used in heat exchangers.

BACKGROUND OF THE ART

In heat exchangers made from multiple, stacked, tubes or plate pairs defining flow passages therein, it is common to use turbulizers located in the tubes or between the plates inside the plate pairs to enhance heat transfer, especially where a liquid, such as oil, passes through these flow passages. These turbulizers are commonly in the form of expanded metal inserts and they have undulations or convolutions formed therein to create turbulence in the flow and in this way increase heat transfer in the heat exchanger.

While conventional turbulizers do increase heat transfer, a difficulty with these turbulizers is that they also increase flow resistance or pressure drop inside the heat exchanger. In fact, the flow resistance increases even more than the heat transfer gain produced by the turbulizer, because only a part of the increased turbulence caused by the turbulizer is effective in promoting heat transfer. The balance is wasted in inefficient eddies or vortices.

The present invention periodically interrupts the convolutions in the turbulizer to form non-convoluted pressure recovery zones located between the convolutions. Surprisingly, this substantially reduces the pressure drop caused by the turbulizer without appreciably reducing heat transfer.

SUMMARY OF THE INVENTION

According to one aspect of the invention, there is provided a turbulizer for a heat exchanger comprising a planar member having a plurality of longitudinal parallel rows of convolutions formed therein. The convolutions are interrupted to form longitudinal neutral channels between groups of adjacent rows of convolutions.

According to another aspect of the invention, there is provided a heat exchanger comprising a pair of back-to-back plates having joined peripheral edges and raised central portions defining a flow passage therebetween. The central portions define spaced-apart inlet and outlet openings. A turbulizer as described next above is located in the flow passage between the inlet and outlet openings.

BRIEF DESCRIPTION OF THE DRAWINGS

Preferred embodiments of the invention will now be described, by way of example, with reference to the accompanying drawings, in which.

DESCRIPTION OF THE PREFERRED EMBODIMENTS

Figure 1:
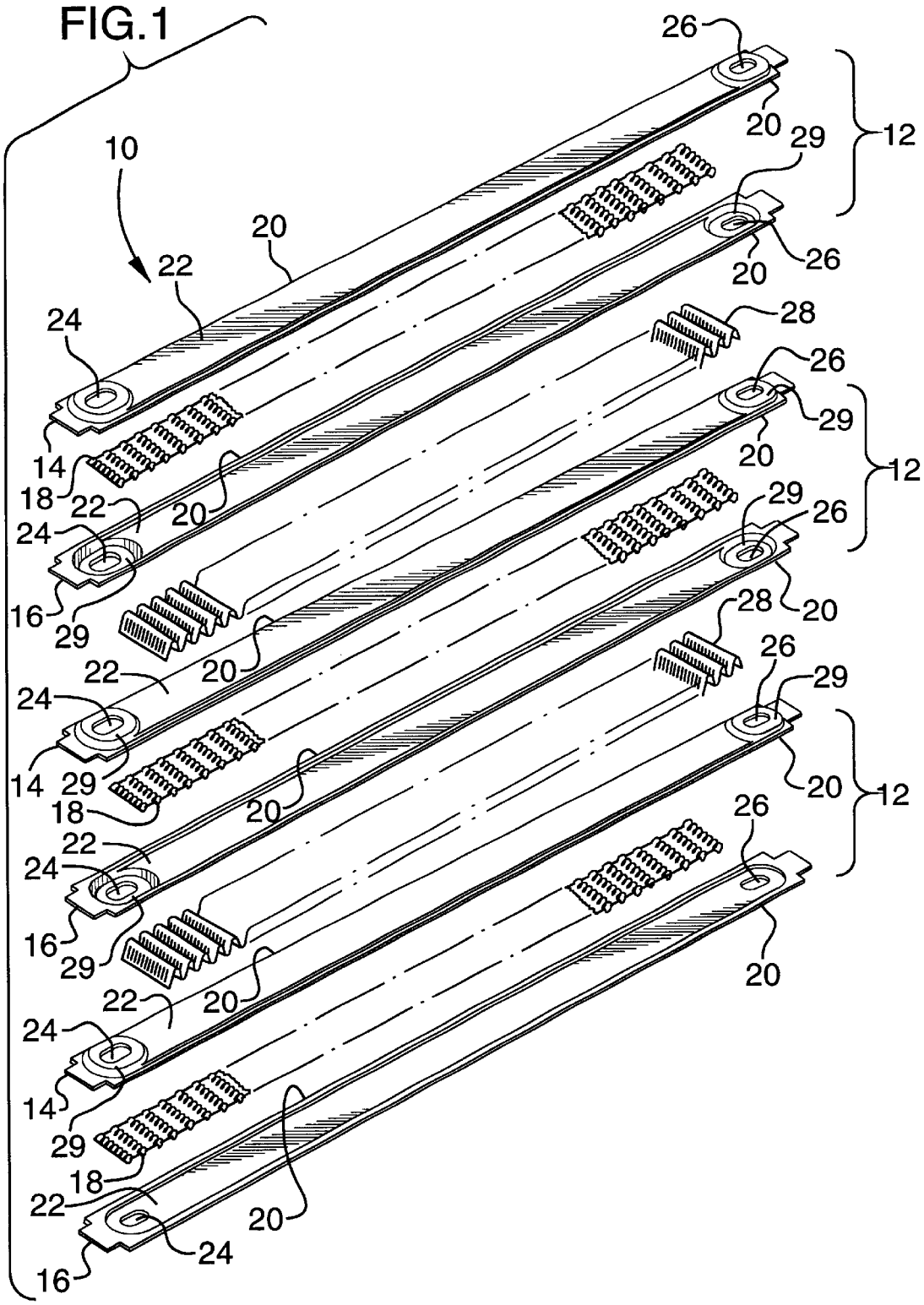
FIG. 1 is an exploded perspective view of a preferred embodiment of a plate type heat exchanger according to the present invention.

Referring to FIG. 1, a preferred embodiment of a heat exchanger according to the present invention is generally indicated by reference numeral 10. Heat exchanger 10 is formed of a plurality of spaced-apart tube members or plate pairs 12, each having an upper plate 14, a lower plate 16 and a turbulizer 18 located therebetween. Plates 14, 16 are arranged back-to-back and have joined peripheral edges 20. Plates 14, 16 also have raised central portions 22 which define a flow passage therebetween in which turbulizers 18 are located. Raised central portions 22 also define spaced-apart inlet and outlet openings 24, 26 for the flow of fluid, such as oil, through the plate pairs. When the heat exchanger is assembled, all of the inlet openings 24 are aligned and in communication forming an inlet header, and all of the outlet openings 26 are aligned and in communication forming an outlet header. Expanded metal fins 28 are located between the plate pairs for allowing another fluid, such as air to flow transversely through the plate pairs. The plates 14,16 that are in contact with fins 28 are spaced apart by raised end bosses 29 to make room for fins 28 between plate central portions 22.

The plates 14, 16 and the fins 28 can be any shape and configuration desired and are not, per se, considered to be part of the present invention. In fact, plates 14, 16 can be formed with outwardly disposed dimples which mate in adjacent plate pairs in which case, fins 28 would not be used.

Figure 2:
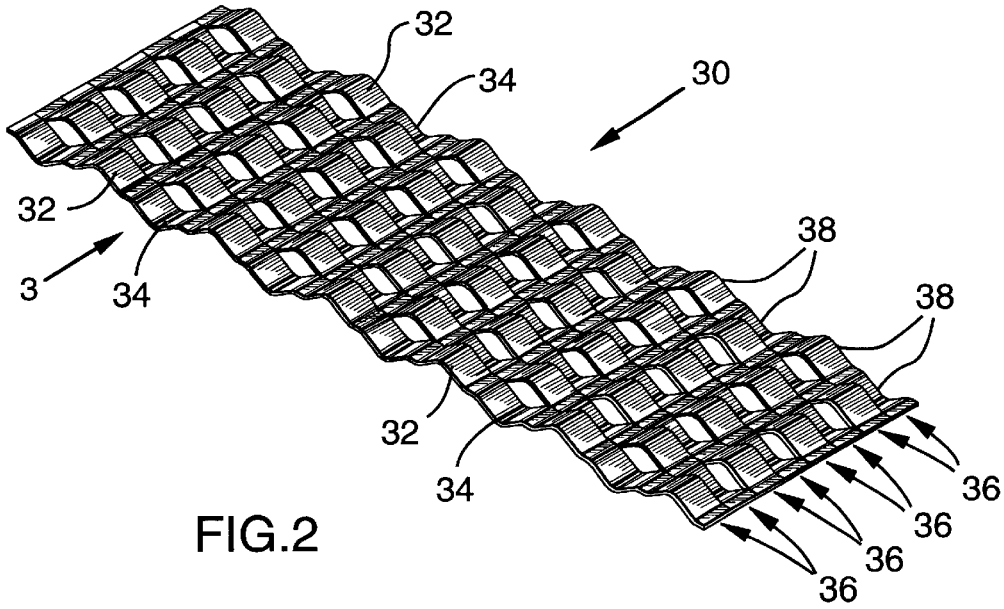
FIG. 2 is an enlarged perspective view of a portion of the turbulizer used in the heat exchanger of FIG. 1.
Figure 3:
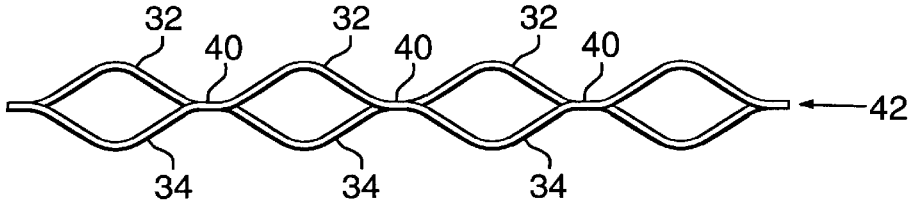
FIG. 3 is an elevational view of a portion of the turbulizer of FIG. 2 taken in the direction of arrow 3 in FIG. 2.
Figure 4:
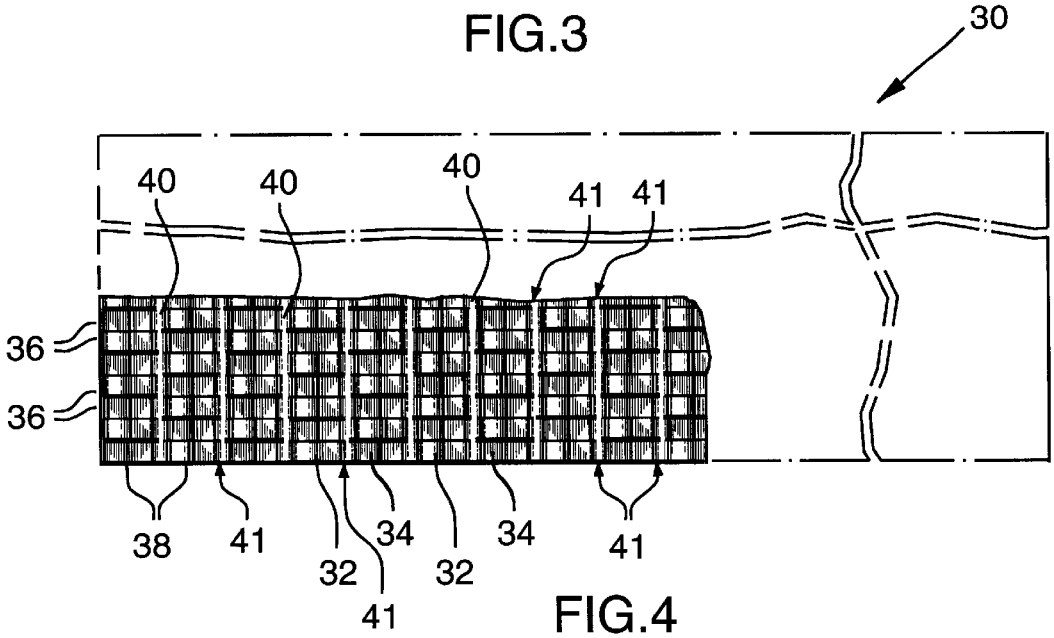
FIG. 4 is a plan view of the turbulizer of FIGS. 2 and 3.

Referring next to FIGS. 2, 3 and 4, a preferred embodiment of a turbulizer 30 is shown which could be used as the turbulizer 18 in FIG. 1. It will be appreciated that FIGS. 5, 8, 11 and 14 show other preferred embodiments of turbulizers. Any one of these could be used as the turbulizer 18 in the heat exchanger 10 shown in FIG. 1. The turbulizers shown in FIGS. 2, 5, 8, 11 and 14 are just illustrations of sections or portions of the turbulizers. It will be appreciated that these turbulizers can be made in any length or width desired depending upon the manufacturing method. The turbulizers usually are stamped or roll-formed out of aluminum about 0.01 inches (0.25 mm) thick. However, other materials and heavier or thinner materials can be used for the turbulizers as well.

Turbulizer 30 is a planar member having a plurality of convolutions 32, 34 formed therein. Convolutions 32, 34 are arranged in parallel rows. Where turbulizer 30 is elongate in shape, convolutions 32, 34 are arranged in parallel, longitudinal rows 36, and also in parallel transverse rows 38.

Convolutions 32,34 are interrupted periodically to form non-convoluted pressure recovery zones 40 located between or downstream of the convolutions 32, 34 in each row of convolutions 36. In other words, the convolutions 32, 34 in each row are spacedapart by pressure recovery zones 40, rather than being located contiguous to one another as is the case in conventional turbulizers.

Turbulizer 30 has a central plane containing pressure recovery zones 40 as indicated by arrow 42 in FIG. 3, and convolutions 32, 34 extend alternately above (convolutions 32) and below (convolutions 34) the central plane 42. Convolutions 32, 34 are in the form of bridges, and turbulizer 30 has a high pressure drop orientation in the direction of the bridges, or in the longitudinal direction, and a low pressure drop orientation in the direction passing under the bridges or the transverse direction. In the embodiment shown in FIG. 2, the convolutions 32, 34 are interrupted in the high pressure drop direction by pressure recovery zones 40 located between or downstream of the convolutions. As seen best in FIG. 4, the pressure recovery zones 40 are located in transverse rows or neutral channels 41 themselves.

When turbulizer 30 is used as the turbulizer 18 in heat exchanger 10 of FIG. 1, fluid flows in the high pressure drop orientation or direction parallel to longitudinal rows 36 from inlet openings 24 to outlet openings 26. The fluid flows around and under or through convolutions 32, 34. This causes turbulence and reduces boundary layer growth increasing the heat transfer co-efficient. However, pressure recovery zones 40 allow for a pressure recovery to reduce flow resistance or pressure drop in the fluid passing from inlet openings 24 to outlet openings 26.

In turbulizer 30, convolutions 32, 34 are aligned in the low pressure drop or transverse direction. Also, pressure recovery zones 40 are aligned in the low pressure drop or transverse direction to form neutral channels 41. Pressure recovery zones 40 thus form continuous neutral channels 41 in the low pressure drop direction. These neutral channels 41 also provide areas that can be used to eject the turbulizer from the dies used to produce the turbulizer.

The width of the convoluted longitudinal rows 36 is preferably as narrow as is practical for tool design and maintenance purposes. For automotive cooling purposes, a preferred minimum width would be about 0.02 inches (0.5 mm). The maximum width should not exceed ten times the minimum. Typically, the maximum width would be about 0.2 inches (5 mm). The longitudinal length of pressure recovery zones 40 ranges from about 5% of the longitudinal or centerline to centerline spacing between convolutions 32, 34 to about 75% of the spacing between any two consecutive convolutions 32,34. A preferable range would be between 0.02 inches (0.5 mm) to about 0.5 inches (1.25 cm), or about 40% to 50% of the centerline to centerline distance between longitudinally consecutive convolutions 32, 34.

The height of convolutions 32,34 above or below the central plane 41 containing pressure recovery zones 42 depends upon the thickness of the material used for turbulizer 30. This height should not be less than the material thickness and typically ranges from this minimum to about 10 times the material thickness where aluminum is used for turbulizer 30. A good range is from 0.01 inches (0.25 mm) to 0.5 inches (1.25 cm).

The longitudinal length of convolutions 32, 34 is normally about 2 times the height of the convolutions. The height normally ranges from about 2 times the material thickness to about 20 times the material thickness. A good range is from 0.02 inches (0.5 mm) to about 1.0 inch (2.5 cm).

Figure 5:
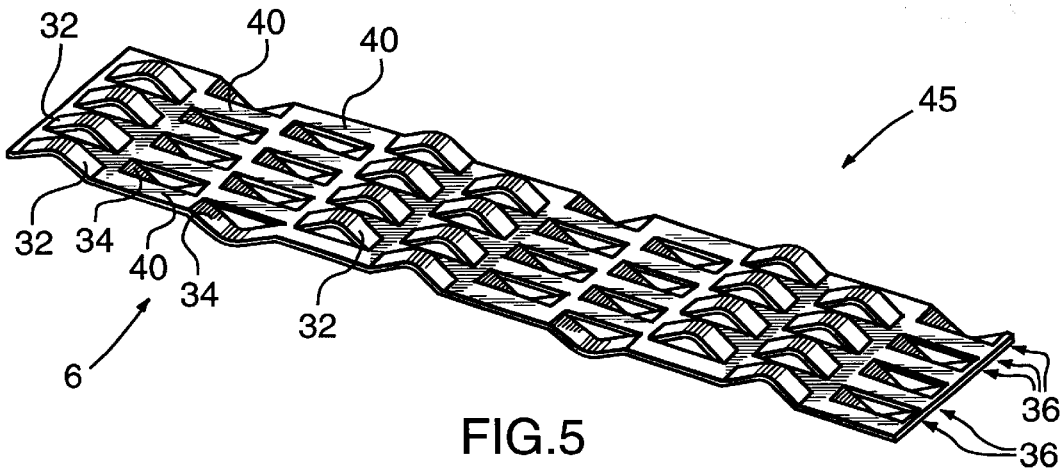
FIG. 5 is a perspective view of another embodiment of a turbulizer according to the present invention.
Figure 6:
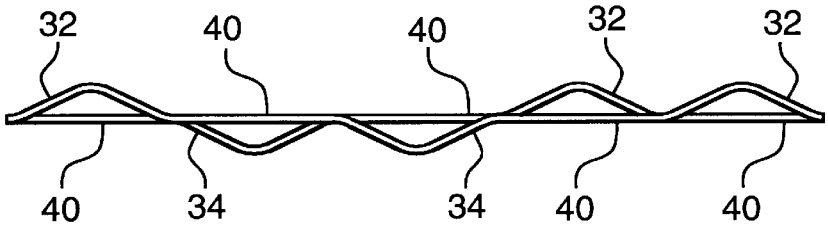
FIG. 6 is an elevational view of a portion of the turbulizer of FIG. 5 taken in the direction of arrow 6 in FIG. 5.
Figure 7:
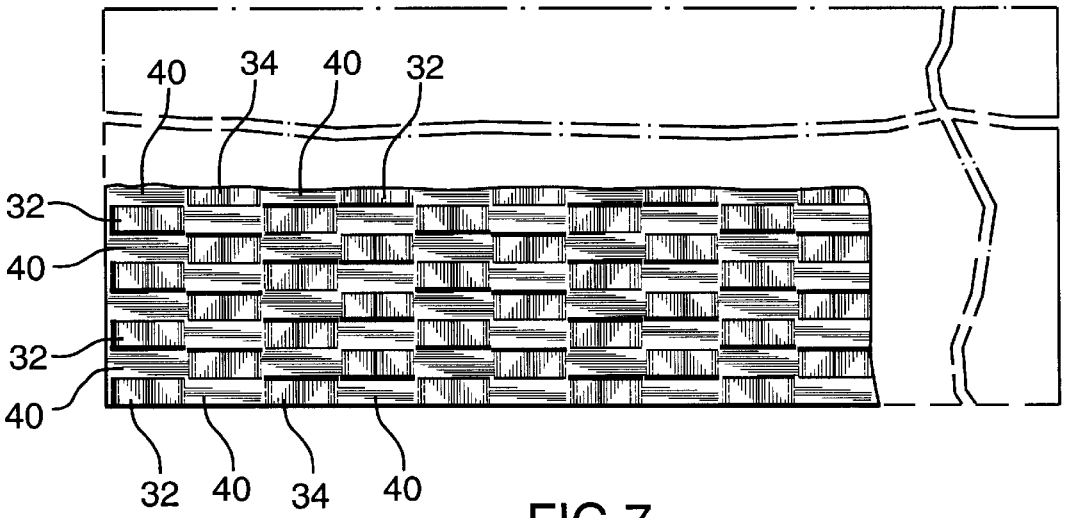
FIG. 7 is a plan view of the turbulizer shown in FIGS. 5 and 6.

Referring next to FIGS. 5, 6 and 7, a turbulizer 45 is shown which is substantially similar to turbulizer 30 except as follows. In turbulizer 45, the convolutions 32, 34 are staggered in the low pressure drop or transverse direction. In other words, the convolutions 32 which extend above the central plane do not line up transversely with the convolutions 34 that extend below the central plane in the adjacent longitudinal rows 36. Convolutions 32, 34 in every other row of convolutions do line up, but they could be staggered as well if desired. The material thickness and dimensions of convolutions 32, 34 and pressure recovery zone 40 are similar to those of turbulizer 30 of FIG. 2.

Figure 8:
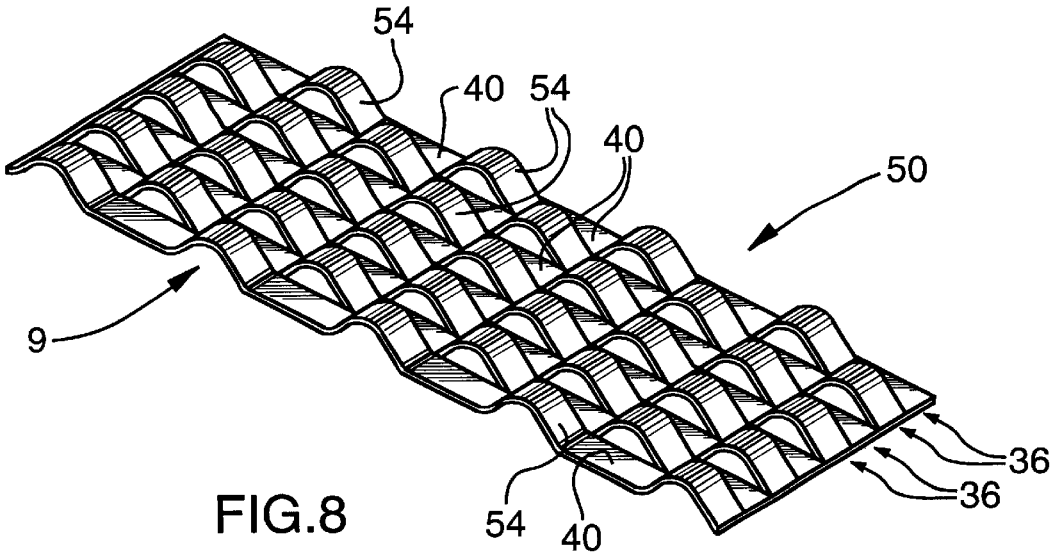
FIG. 8 is a perspective view of yet another embodiment of a turbulizer according to the present invention.
Figure 9:
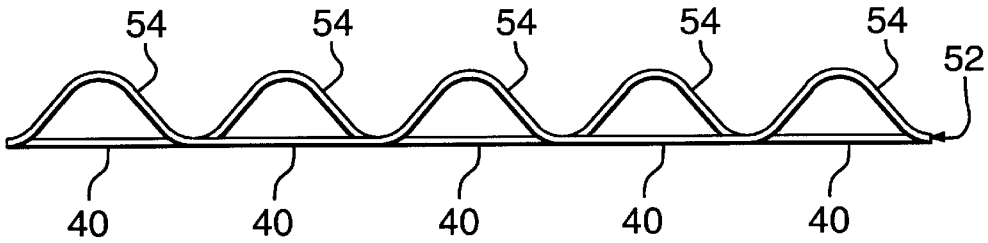
FIG. 9 is an elevational view of a portion of the turbulizer of FIG. 8 taken in the direction of arrow 9 in FIG. 8.
Figure 10:
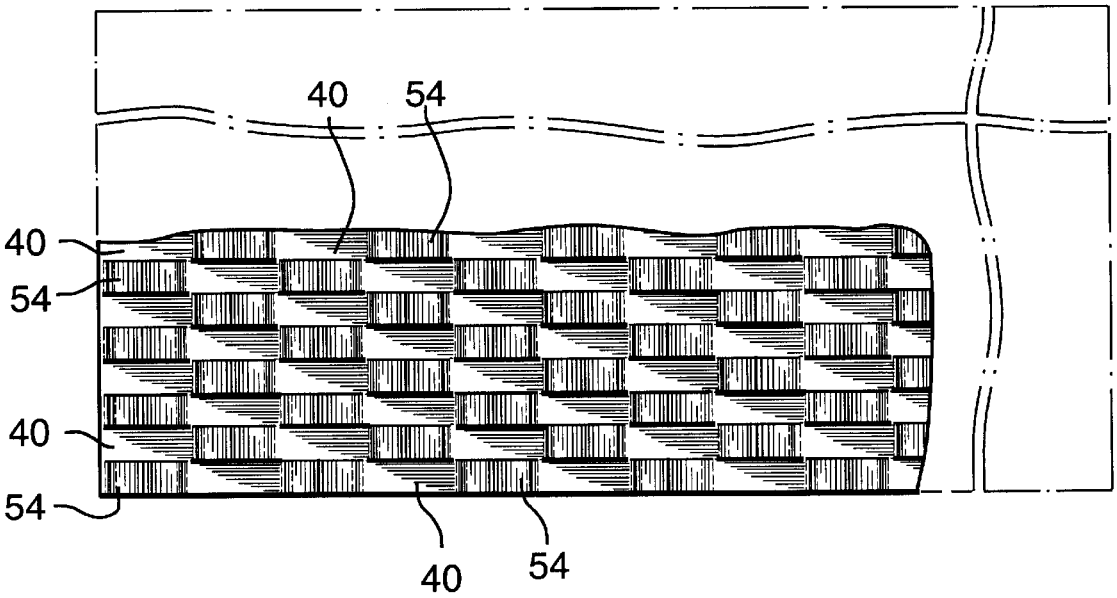
FIG. 10 is a plan view of the turbulizer shown in FIGS. 8 and 9.

Referring next to FIGS. 8, 9 and 10, yet another embodiment of turbulizer 50 is shown wherein the convolutions are staggered in the low pressure drop or transverse direction. In turbulizer 50, all of the pressure recovery zones 40 are contained in a common reference plane 52 (see FIG. 9) and all of the convolutions 54 extend in the same direction relative to this reference plane 52. In all other respects, turbulizer 50 is similar to turbulizers 30 and 45.

Figure 11:
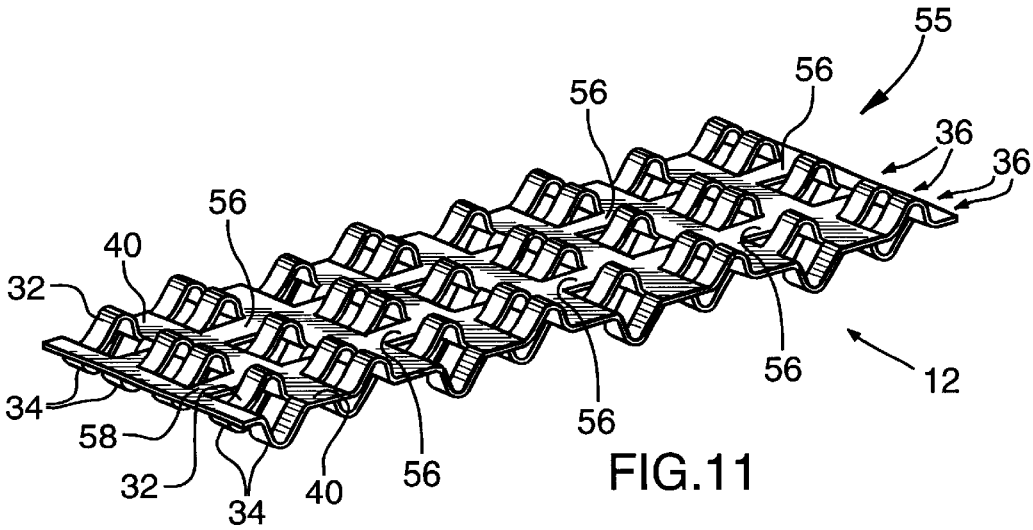
FIG. 11 is a perspective view of yet another embodiment of a turbulizer according to the present invention.
Figure 12:
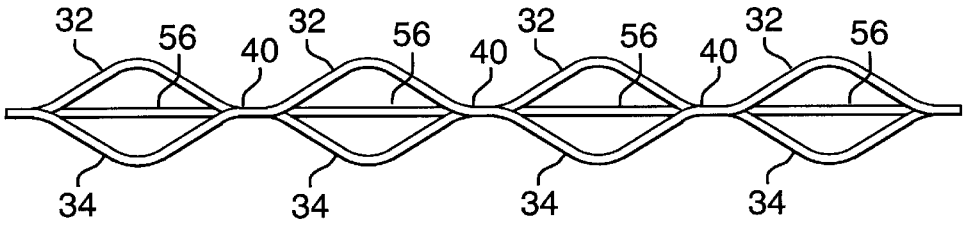
FIG. 12 is an elevational view of a portion of the turbulizer of FIG. 11 taken in the direction of arrow 12 in FIG. 11.
Figure 13:
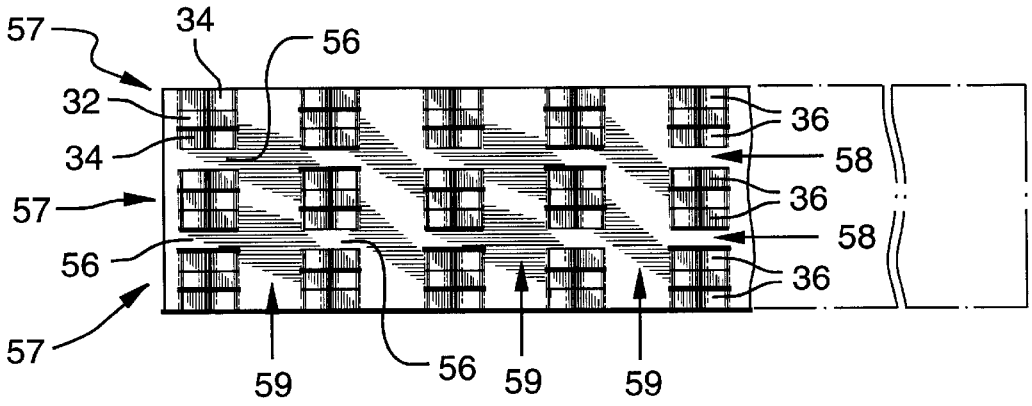
FIG. 13 is a plan view of the turbulizer shown in FIGS. 11 and 12.

Referring next to FIGS. 11, 12 and 13, a turbulizer 55 is shown that is most similar to turbulizer 30 of FIG. 2, except the convolutions 32, 34 are also interrupted in the low pressure drop direction to form further pressure recovery zones 56 located between some of the rows of convolutions 36. Actually, pressure recovery zones 56 extend longitudinally the full length of turbulizer 55 to form longitudinal neutral channels 58 in the high pressure drop or longitudinal direction of turbulizer 55. The neutral channels 58 are located between groups 57 of adjacent rows of convolutions 36. Groups 57 include three rows of convolutions, there being a single longitudinal neutral channel 58 between each group. For manufacturing purposes, the width of neutral channels 58 preferably is about the same as the width of the rows of convolutions 36. However, the width of the neutral channels can be narrower or wider than the rows of convolutions. Wider neutral channels would produce less pressure drop in the high pressure drop direction and narrower neutral channels would produce relatively higher pressure drop. In turbulizer 55, the convolutions 32, 34 are aligned in the low pressure drop or transverse direction, but they could be staggered as well. Where convolutions 32, 34 are aligned in the low pressure drop or transverse direction, it will be appreciated that pressure recovery zones 40 are aligned to give transverse neutral channels 59 in the low pressure drop direction, and pressure recovery zones 56 are aligned to give longitudinal neutral channels 58 in the high pressure drop direction. Where convolutions 32, 34 are staggered, only longitudinal neutral channels 58 would be formed. In all other respects, turbulizer 55 is similar to turbulizers 30, 45 and 50.

Figure 14:
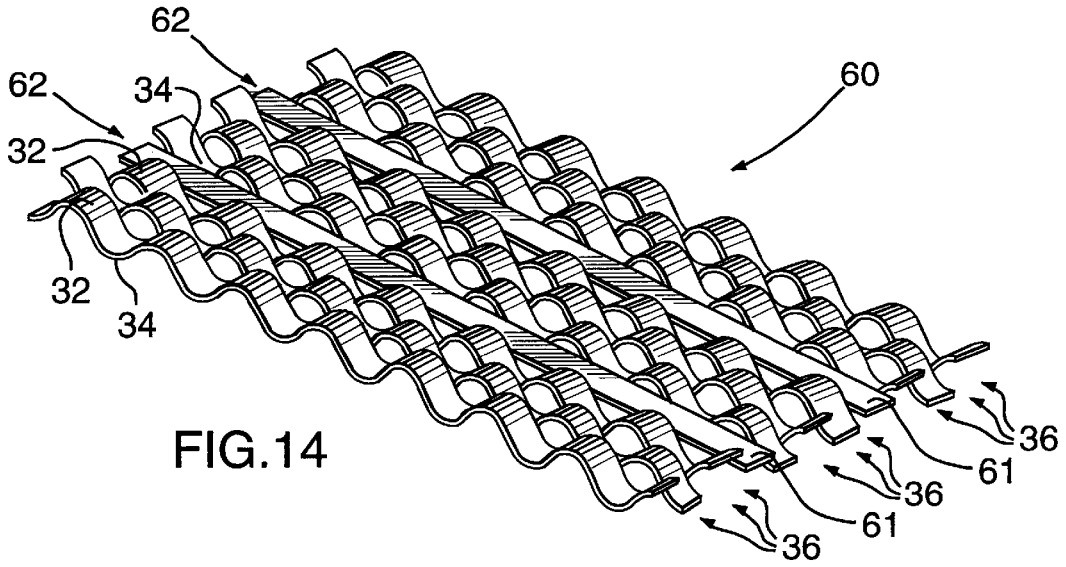
FIG. 14 is a perspective view of yet another embodiment of a turbulizer according to the present invention.
Figure 15:
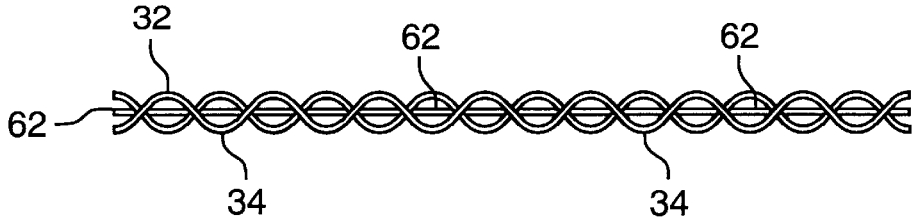
FIG. 15 is a side elevational view of the turbulizer shown in FIG. 14.
Figure 16:
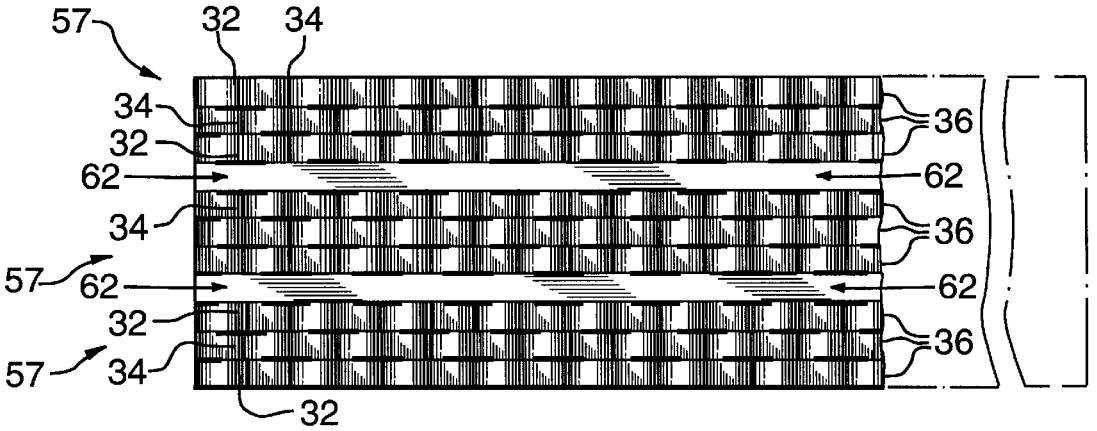
FIG. 16 is a plan view of the turbulizer shown in FIGS. 14 and 15.

Referring next to FIGS. 14, 15 and 16, a turbulizer 60 is shown where the convolutions 32, 34 are interrupted only in the low pressure drop or transverse direction and only between some of the rows of convolutions 36. These interruptions make pressure recovery zones 61 in the form of longitudinal neutral channels 62. In all other respects, turbulizer 60 is similar to turbulizers 30, 45, 50 and 55. In FIGS. 14 to 16, turbulizer 60 is shown cut to length in the middle of convolutions 32, 34. This has been done for the purposes of illustration. In practice, the turbulizers would normally be cut to length between the convolutions, as is the case in FIGS. 1 to 13.

Figure 17:
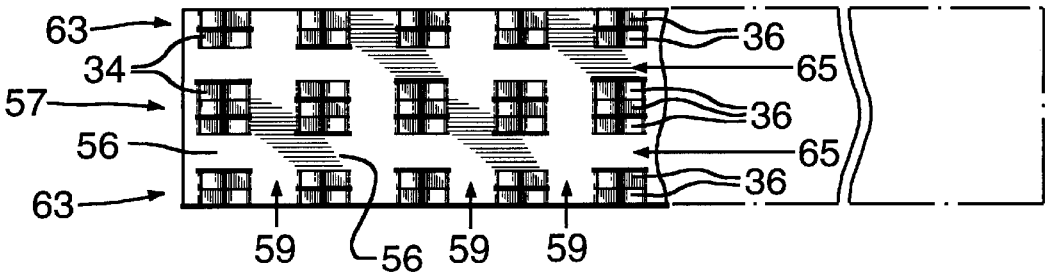
FIGS. 17 to 21 are plan views similar to FIG. 13, but showing other preferred embodiments having different configurations of rows of convolutions and neutral channels.

FIG. 17 shows another preferred embodiment of a turbulizer similar to that shown in FIG. 13, but having a central group 57 of three longitudinal rows of convolutions 36 and a double width neutral channel 65 on either side of the central group 57. A group 63 of two longitudinal rows of convolutions 36 is located on either side of neutral channels 65.

Figure 18:
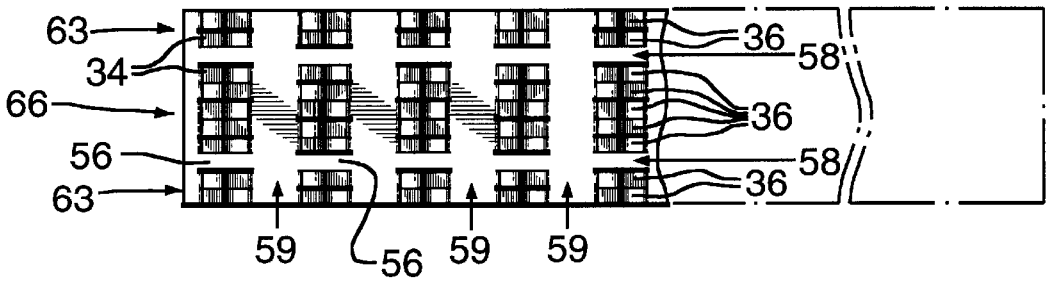

FIG. 18 is another preferred embodiment of a turbulizer similar to that shown in FIG. 13, but having a central group 66 of five longitudinal rows of convolutions 36, longitudinal neutral channels 58 on either side of central group 66, and a group 63 of two rows of convolutions on either side of neutral channels 58.

Figure 19:
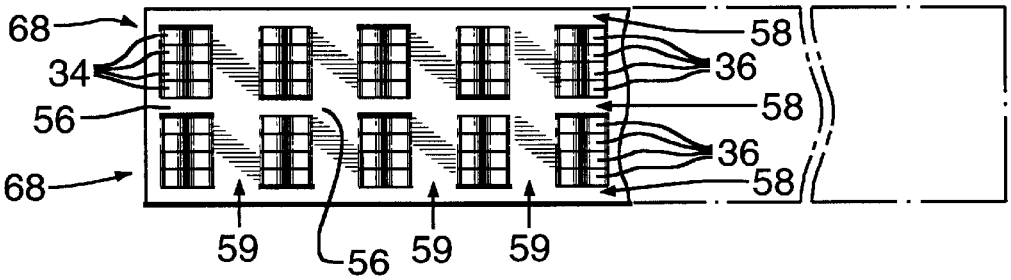

FIG. 19 again is another preferred embodiment of a turbulizer similar to that shown in FIG. 13, but having two groups 68 of four longitudinal rows of convolutions 36, and a longitudinal neutral channel 58 between and on either side of the groups 68 of convolutions.

Figure 20:
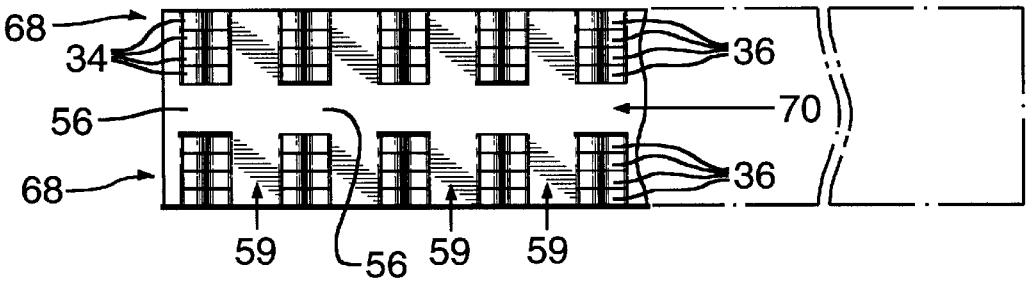

FIG. 20 is yet another preferred embodiment of a turbulizer similar to that shown in FIG. 13, but having two groups 68 of four longitudinal rows of convolutions 36 and a triple width neutral channel 70 located between the two groups 68.

Figure 21:
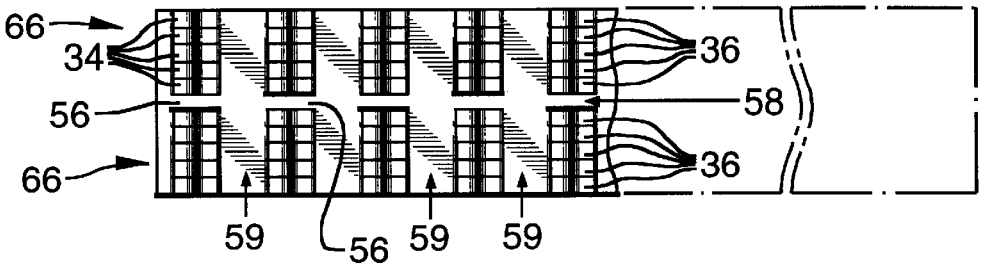

FIG. 21 is yet another preferred embodiment of a turbulizer similar to that shown in FIG. 13, but having two groups 66, of five rows of convolutions and a longitudinal neutral channel 58 located therebetween.

Figure 22:
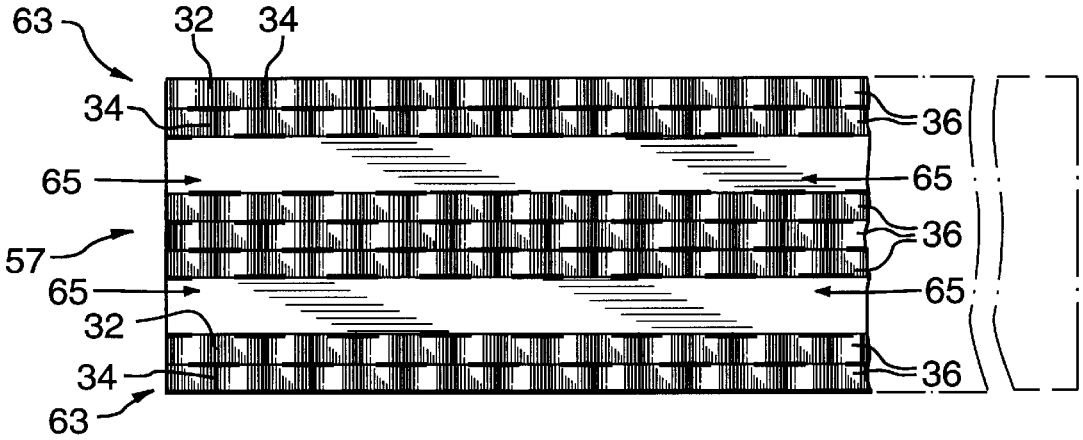
FIGS. 22 to 26 are plan views similar to FIG. 16, but showing other preferred embodiments having different configurations of rows of convolutions and neutral channels.

FIG. 22 shows another preferred embodiment of a turbulizer similar to that shown in FIG. 16, but having a central group 57 of three longitudinal rows of convolutions 36 and a double width neutral channel 65 on either side of the central group 57. A group 63 of two longitudinal rows of convolutions 36 is located on either side of neutral channels 65.

Figure 23:
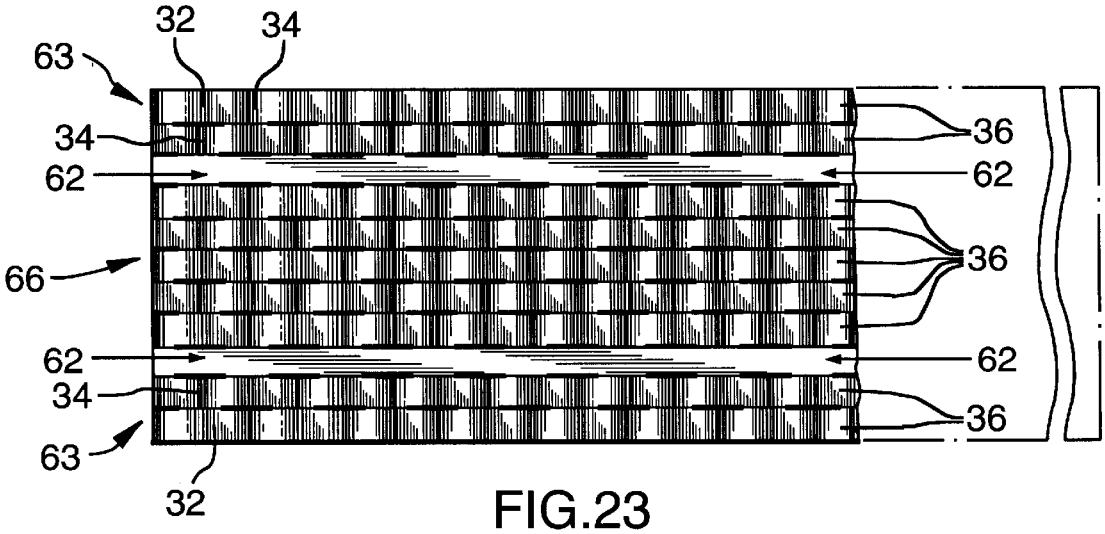

FIG. 23 shows another preferred embodiment of a turbulizer similar to that shown in FIG. 16, but having a central group 66 of five longitudinal rows of convolutions 36, longitudinal neutral channels 62 on either side of central group 66, and a group 63 of two rows of convolutions on either side of neutral channels 62.

Figure 24:
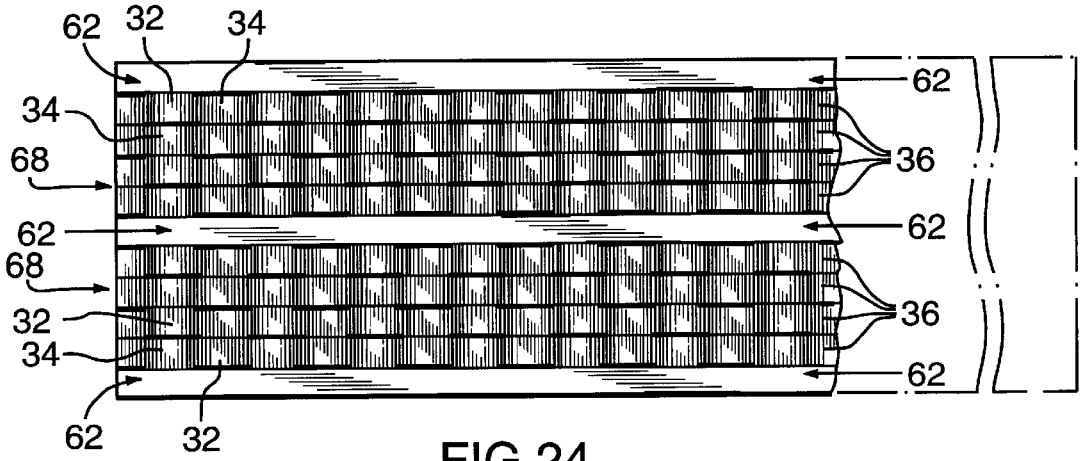

FIG. 24 shows another preferred embodiment of a turbulizer similar to that shown in FIG. 16, but having two groups 68 of four longitudinal rows of convolutions 36, and a longitudinal neutral channel 62 between and on either side of the groups 68 of convolutions.

Figure 25:
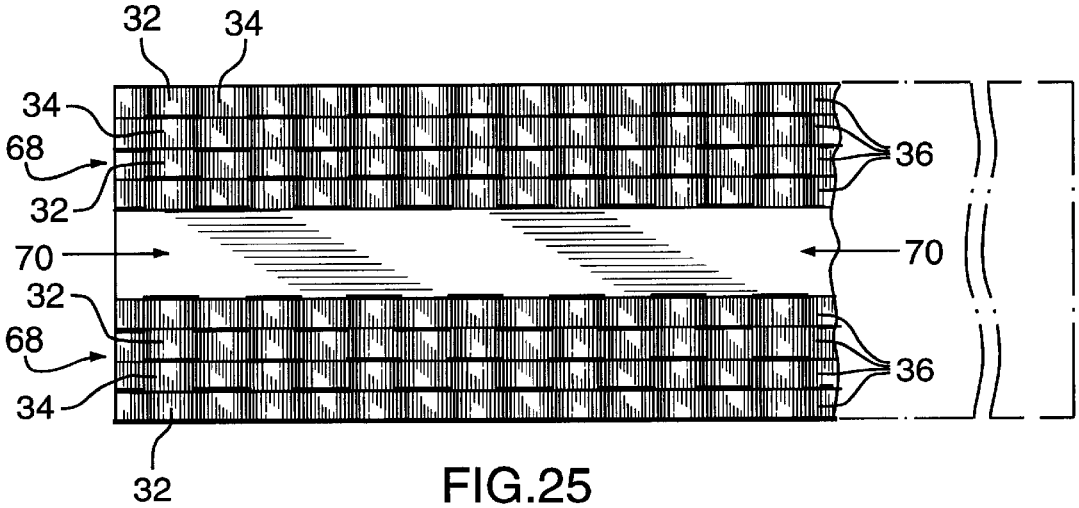

FIG. 25 is yet another preferred embodiment of a turbulizer similar to that shown in FIG. 16, but having two groups 68 of four longitudinal rows of convolutions 36 and a triple width neutral channel 70 located between the two groups 68.

Figure 26:
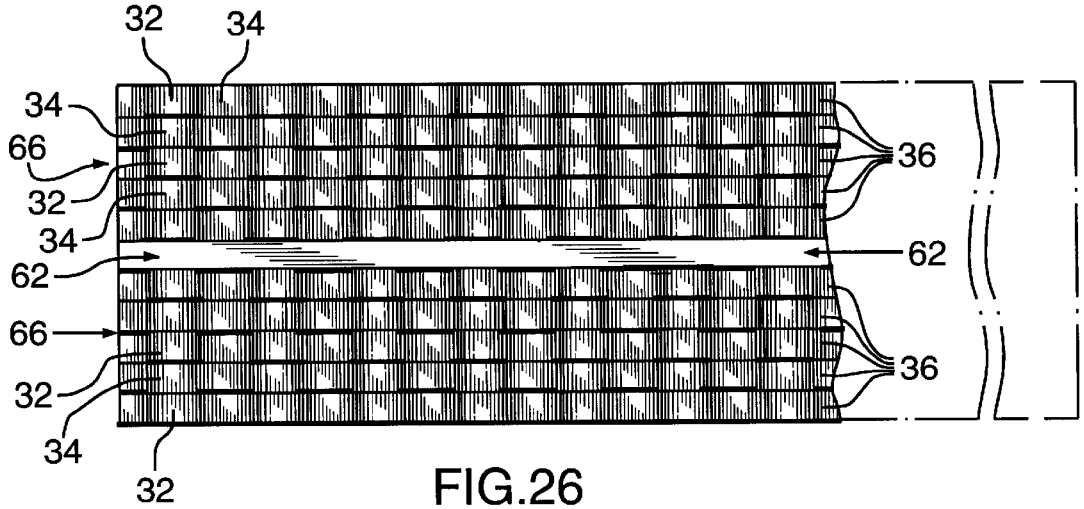

FIG. 26 is yet another preferred embodiment of a turbulizer similar to that shown in FIG. 16, but having two groups 66, of five rows of convolutions 36 and a longitudinal neutral channel 62 located therebetween.

Having described preferred embodiments of the invention, it will be appreciated that various modifications can be made to the structures described above. For example, instead of using plate pairs 12 as tube members defining the flow passages containing turbulizers 18, continuous flat or oblong tubes could be used instead. In this case, turbulizers 18 would be inserted lengthwise into one end of the tubes. In turbulizers 18, the convolutions 32, 34 have been shown to be rounded with various curvatures. These convolutions can be any configuration, such as semi-circular, sinusoidal, trapezoidal or even V-shaped, if desired. In heat exchanger 10 shown in FIG. 1, turbulizer 18 is shown to be orientated such that the flow is in the high pressure drop or longitudinal direction. However, the turbulizer could be rotated 90 degrees so that the flow from inlet 24 to outlet 26 is in the low pressure drop direction if desired. It will also be appreciated that the various features of turbulizers 30, 45, 50, 55 and 60 could be mixed and matched, or a combination of these features could be employed in the same turbulizer. Also, any given heat exchanger could have any one or a combination of the turbulizers described above. Finally, the patterns of rows of convolutions and neutral channels can be repeated or mixed and matched where the turbulizers are wider than indicated in the drawings attached hereto. Other modifications to the structure described above will be apparent to those skilled in the art.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A turbulizer for a heat exchanger comprising:

an elongate planar member having a plurality of groups of adjacent longitudinal parallel rows of convolutions formed therein, said convolutions being interrupted to form longitudinal neutral channels between said groups of adjacent rows of convolutions.

2. A turbulizer for a heat exchanger as claimed in claim 1 wherein the convolutions are in the form of bridges, the turbulizer having a high pressure drop orientation in the direction of the bridges and a low pressure drop orientation in the direction passing under the bridges.

3. A turbulizer for a heat exchanger as claimed in claim 2 wherein the rows of convolutions are further interrupted in the high pressure drop direction to form pressure recovery zones located longitudinally between the convolutions.

4. A turbulizer for a heat exchanger as claimed in claim 3 wherein the convolutions are aligned in the low pressure drop direction, the pressure recovery zones also being aligned transversely to form neutral channels in the low pressure drop direction.

5. A turbulizer for a heat exchanger as claimed in claim 2 wherein the convolutions are staggered in the low pressure drop direction.

6. A turbulizer for a heat exchanger as claimed in claim 2 wherein the convolutions are aligned in the low pressure drop direction.

7. A turbulizer for a heat exchanger as claimed in claim 3 wherein the turbulizer has a central plane containing the pressure recovery zones, and wherein the convolutions in each row of convolutions extend alternately above and below the central plane.

8. A turbulizer for a heat exchanger as claimed in claim 5 wherein the turbulizer has a central plane containing the pressure recovery zones, and wherein the convolutions in each row of convolutions extend alternately above and below the central plane.

9. A turbulizer for a heat exchanger as claimed in claim 1 wherein said groups include three rows of convolutions, there being a single longitudinal neutral channel between each group.

10. A turbulizer for a heat exchanger as claimed in claim 1 wherein there is a central group of three rows of convolutions, double width neutral channels on either side of said central group, and a group of two rows of convolutions on either side of said neutral channels.

11. A turbulizer for a heat exchanger as claimed in claim 1 wherein there is a central group of five rows of convolutions, neutral channels on either side of said central group, and a group of two rows of convolutions on either side of the neutral channels.

12. A turbulizer for a heat exchanger as claimed in claim 1 wherein there are two groups of four rows of convolutions and a neutral channel between and on either side of said groups of convolutions.

13. A turbulizer for a heat exchanger as claimed in claim 1 wherein there are two groups of four rows of convolutions and a triple width neutral channel located between said two groups of convolutions.

14. A turbulizer for a heat exchanger as claimed in claim 1 wherein there are two groups of five rows of convolutions and a longitudinal neutral channel located therebetween.

15. A heat exchange comprising:

a plurality of spaced-apart tube members defining flow passages therebetween; said tube members defining spaced-apart inlet and outlet openings; and a turbulizer as claimed in claim 1 located in at least one of the flow passages between the respective inlet and outlet openings.

16. A heat exchanger comprising:

a plurality of spaced-apart tube members defining flow passages therebetween; said tube members defining spaced-apart inlet and outlet openings; and a turbulizer as claimed in claim 9 located in at least one of the flow passages between the respective inlet and outlet openings.

17. A heat exchanger as claimed in claim 15 wherein the tube members are formed of back-to-back plates having joined peripheral edges and raised central portions defining said flow passages.

18. A heat exchanger as claimed in claim 16 wherein the tube members are formed of back-to-back plates having joined peripheral edges and raised central portions defining said flow passages.

* * * * *